United States Patent [19]

Uyeda

[11] Patent Number: 4,541,259

[45] Date of Patent: Sep. 17, 1985

[54] COMBINATION LOCK

[75] Inventor: Tim M. Uyeda, South San Gabriel, Calif.

[73] Assignee: La Gard, Inc., Torrance, Calif.

[21] Appl. No.: 289,452

[22] Filed: Aug. 3, 1981

[51] Int. Cl.[4] ..... E05B 9/00; E05B 37/08; E05B 41/00

[52] U.S. Cl. ..... 70/316; 70/319; 70/330; 70/432; 70/443; 70/462

[58] Field of Search ..... 70/315–317, 70/323, 327, 328, DIG. 75, 462, 322, 302, 319, 303 R, 320, 318, 330, 331, 432, 443, 450; 292/244

[56] References Cited

U.S. PATENT DOCUMENTS

| | | | |
|---|---|---|---|
| 447,623 | 3/1891 | Rogers | 292/244 |
| 745,080 | 11/1903 | Smith | 70/316 |
| 1,092,874 | 4/1914 | Taylor | 70/317 |
| 1,644,650 | 10/1927 | Millice | 70/316 |
| 1,863,537 | 6/1932 | Aster | 70/303 R |
| 2,900,813 | 8/1959 | Miller | 70/303 R |
| 4,142,388 | 3/1979 | Phillips . | |
| 4,312,199 | 1/1982 | Uyeda . | |
| 4,353,231 | 10/1982 | Uyeda . | |

*Primary Examiner*—Robert L. Wolfe
*Assistant Examiner*—Lloyd A. Gall
*Attorney, Agent, or Firm*—Poms, Smith, Lande & Rose

[57] ABSTRACT

An easily assembled combination lock has improved tumbler wheel construction, combination changing apparatus, and a bi-positional lock cover which selects between spring-bolt and dead-bolt operation. The improved tumbler wheels have two-piece construction, an inner drive member having a projection, groove and stop assembly cooperating with adjacent tumbler wheels, and a gate ring having a gate and improved gripping apparatus for frictionally engaging the gate ring with the inner drive member. The inner drive member has multiple ratchet teeth about its periphery and the improved gripping apparatus includes a pair of diametrically opposed gripping straps integral with the gate ring, in tension, and tangentially contacting the periphery of the inner drive member imparting a predetermined frictional resistance to rotation. Two normal modes of tumbler wheel operation are contemplated. Mode selecting structure is included on the lock cover to select between spring-bolt mode of bolt operation and dead-bolt mode of bolt operation merely by changing the orientation of the lock cover relative to the lock mechanism and housing.

14 Claims, 11 Drawing Figures

50
54
58
55
53
56
52
37
30
10
51
12
77
49
42
47
41
36
18
33
32
40
46
35
45
37
34
16
13
11
77
38
39
98
63
85
81
36
39
97
38
67
31
61
39
85
62
86
88
87
80
60
39
38
98
85
61
63
62
86
81
81
80
68
93
69
99
90
80
82
97
24
20
21
25
75
89
74
29
70
24
26
28
72
21
27
73
76
71

COMBINATION LOCK

This invention relates generally to combination locks and, more specifically, to locks which are easily assembled, have a changeable combination, and may be selectively operated in more than one mode.

BACKGROUND OF THE INVENTION

Lock mechanisms are generally used to maintain the door of an enclosure in a closed condition thereby securing the enclosure from unwanted entry and the contents of the enclosure from theft. These mechanisms usually have a bolt structure carried by the door which engages a latch or recess of the door frame portion of the enclosure to maintain the door in a closed and locked position. The bolt structure is selectively moveable out of engagement with the latch recess by a predetermined manipulation of the lock mechanism. This manipulation may be the insertion and rotation of a specially configured key, or may be the pre-determined sequence of rotations of a combination dial.

These enclosures may be safes, storage rooms, vehicles, homes, or offices. Depending on the type of enclosure, one of two common modes of bolt operation is employed. One of these modes is known as dead-bolt operation in which the bolt structure is moved between locked and unlocked positions only by manipulation of the lock mechanism. In this mode, in order to engage the bolt with the latch recess thereby locking the door of an enclosure, a positive manipulation of the lock mechanism is required.

The other common mode of bolt operation is spring-bolt operation wherein the bolt is biased to the locked position by a spring and the bolt is configured with a slanted ramp surface by which motion of the door from the open to the closed position results in automatic locking of the door. Specifically, the motion of the door causes the frame of the door or enclosure to engage the slanted surface of the bolt overcoming the bias of the spring and causing the bolt to be retracted from the locked to the unlocked position. Further motion allows the bolt to be aligned with the recess, releasing the bolt to the locked position under the urging of the spring such that the bolt automatically extends into the recess or latch of the door frame. Spring-lock operation permits locking of the door as it closes without requiring positive manipulation of the lock mechanism.

In the particular application of doors for houses, lock mechanisms have been manufactured to function by each of the described modes of bolt operation. Once a lock having one of the modes of operation was installed in a door, however, it was necessary to completely replace the lock mechanism in order to change the mode of bolt operation. Since it is very rare for two different lock mechanisms to utilize the same mounting holes or bolt locations, it is usually an expensive and destructive process to change the lock mechanism of a door in order to change the mode of bolt operation.

One common lock mechanism is the combination lock wherein the exterior surface of the door has a circular rotatable dial with numeric indicia about its periphery and a stationary marker proximate the dial as a reference point. This type of lock mechanism is operated by manipulation of the dial in a pre-determined sequence of alternating clockwise and counter-clockwise rotations aligning specified numeric indicia with the marker. The specified sequence of manipulations permits the bolt to be moved to the unlocked position by either a further manipulation of the dial or a manipulation of a separate lever or handle. A mechanism utilized to accomplish this function is exemplified by U.S. Pat. No. 4,142,388 entitled "Tumbler Wheels for Combination Locks", issued to Peter J. Phillips on Mar. 6, 1979.

Combination lock mechanisms typically include a number of rotatable tumbler wheels, each wheel having a gate member positioned at one point about its periphery for receiving and cooperating with a pawl. Each of the tumbler wheels further includes a projection on one side and an annular groove with a stop on the other side. The projection of one wheel cooperates with a groove-and-stop assembly of an adjacent tumbler wheel whereby a particular tumbler wheel may rotate a portion of a full revolution independently of the adjacent wheel and then the projection engages the stop contained within the groove causing simultaneous subsequent rotation of the adjacent tumbler wheel.

The stop, groove and projection, and the gate means have a pre-determined angular orientation which dictates one of the rotational manipulations required of the combination lock dial. The proper sequence of manipulations causes the gate means of each of the multiple tumbler wheels to become aligned such that a single pawl member may rotate radially inward with respect to the multiple tumbler wheels into the gate members. This alignment of the gate means and resulting motion of the pawl places the lock in a condiiton which permits unlocking motion of the bolt by a further manipulation of the lock mechanism.

It is also commonly known for combination locks to have a changeable combination. Once each of the gate means of the tumbler wheels has been aligned as just described, a keyway portion of each tumbler wheel is similarly aligned and may receive a specially configured key. For the combination lock to have a changeable combination, it is necessary that the tumbler wheels have a multi-part construction such that the angular orientation of the stop and projection relative to the gate means may be changed. Typical tumbler wheels are comprised of an outer gate ring, including a gate for cooperation with a pawl, an inner drive ring with a projection, stop and groove assembly, and a cam, securing or locking mechanism for causing the outer gate ring and the inner drive ring to rotate in a unitary manner.

Prior tumbler wheels had extensive multi-part locking devices for securing the gate ring to the inner drive ring preventing inadvertent rotation of the gate formed as part of the gate ring relative to the inner drive ring having the projection, groove and stop. These locking devices are expensive to manufacture, are complex to assemble, may be unreliable, and required a specially configured key and complex series of key manipulations in order to change the lock combination.

SUMMARY OF THE PRESENT INVENTION

Accordingly, it is a primary object of the present invention to disclose and provide a combination lock that overcomes these disadvantages. More particularly, the objects of the present invention include disclosing and providing a combination lock that: has a mechanism adapted to utilize either a spring-bolt configuration or a dead-bolt configuration and function consistently therewith; has all parts interchangeable with either a spring-bolt or a dead-bolt; has a lock mechanism which may be switched between spring-bolt and dead-bolt modes of bolt operation merely by changing the orientation of the lock cover; is simply, easily and inexpensively assembled; is formed of simply designed parts not requiring expensive materials; has tumbler wheels with only two-piece snap-together construction; has a changeable combination, said combination being easily changed by a simple rod-shaped pin which may be inserted in any rotational orientation into the lock mechanism; has a highly reliable means for imparting a predetermined frictional resistance to rotation of the gate ring relative to the inner drive member; and has a variable length break-away shaft for ease of mounting to any thickness of door.

Briefly, the present invention comprises an easily assembled combination lock having improved tumbler wheel construction, combination changing apparatus, and a bi-positional lock cover which selects between spring-bolt and dead-bolt operation. According to one feature of the invention, the improved tumbler wheels have two-piece construction, an inner drive member having a projection, groove and stop assembly cooperating with adjacent tumbler wheels, and a gate ring having a gate and improved gripping apparatus for frictionally engaging the gate ring with the inner drive member. The inner drive member has multiple ratchet teeth about its periphery and the improved gripping apparatus includes a pair of diametrically opposed gripping straps integral with the gate ring, in tension, and tangentially contacting the periphery of the inner drive member imparting a predetermined frictional resistance to rotation.

Two normal modes of tumbler wheel operation are contemplated. In combination-dialing mode the inner drive member and the gate ring rotate in a unitary manner in response to the gripping apparatus, preserving the rotational orientation of the gate relative to the groove, stop and projection which is determinant of the lock combination. In combination-changing mode the inner drive member rotates relative to the gate ring to change their relative orientation and thereby change the combination.

In accordance with the combination changing feature of the invention, a rod shaped pin is simply inserted in any rotational orientation through apertures in the gate rings causing the rings to be held stationary and the frictional resistance to rotation to be overcome, thereby permitting rotation of the inner drive member relative to the gate ring changing their relative rotational orientation and thereby changing the lock combination.

Each member in tension or strap of the gripping means can be easily manufactured by forming a semicircular cutout in the gate ring proximate its central bore. Said cutout leaves an elongated strap integral with the gate ring extending between two angularly displaced anchor points at the ends of the cutout. Insertion of the inner drive member into the bore of the gate ring stretches the strap about the member's periphery thereby placing the strap in tension. This tension causes a predetermined frictional resistance to rotation therebetween at the point of tangential contact. Contact teeth on the strap at that point of contact engage with ratchet teeth on the periphery of the inner drive member to cause relative rotation to occur in a ratcheting manner and the inner drive member to be capable of having only a finite number of rotational orientations relative to the gate ring and corresponding to integer number positions of the combination lock dial.

In accordance with another feature of the present invention, an identity of lock mechanism parts may be used with either a spring-bolt configuration or a dead-bolt configuration of bolt. Mode selecting structure is included on the lock cover to select between spring-bolt mode of bolt operation and dead-bolt mode of bolt operation merely by changing the orientation of the lock cover relative to the lock mechanism and housing. More specifically, a cam-like surface is contained on one portion of the lock cover for engaging the pawl of the lock mechanism to prevent unlocking motion of the bolt without proper manipulation of the lock dial whenever the lock cover is mounted in an orientation associated with dead-bolt mode of bolt operation. Mounting the lock cover in the other orientation, associated with spring-bolt mode of bolt operation, allows unrestricted motion of the bolt in the unlocking direction whenever a force on the bolt in the unlocking direction overcomes the biasing of the bolt spring in the locking direction, such as when the ramp surface of a spring-bolt configuration of bolt encounters the latch surface of a door frame or enclosure as during closing of the door.

All of the foregoing is accomplished with simple uniform parts that are interchangeable with either a spring-bolt configuration or dead-bolt configuration of bolt and which are simply manufactured of inexpensive materials and which principally snap together or drop into the lock housing permiting rapid, simplified, and inexpensive assembly.

The present invention can be more fully understood by one skilled in the art and additional advantages and features can be recognized from a consideration of a detailed description of a preferred exemplary embodiment of the invention, and drawings thereof, as foolows:

Figure 9:
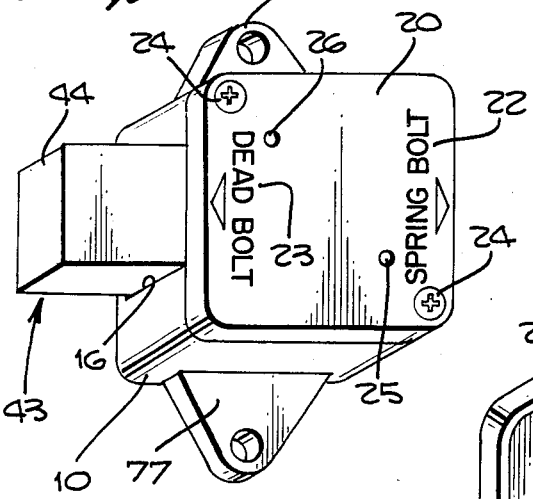
FIG. 9 is an orthographic top view of the assembled lock mechanism of the present invention adapted for dead-bolt operation.
Figure 10:
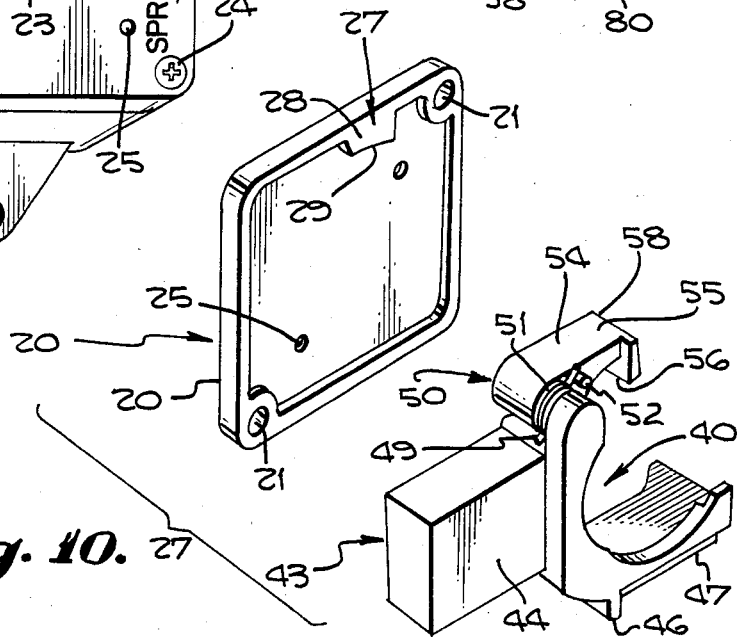
FIG. 10 is a perspective view of the interior side of the lock cover, dead-bolt configuration of bolt means, pawl and pawl spring portions of the present invention in a partially-assembled condition.
Figure 11:
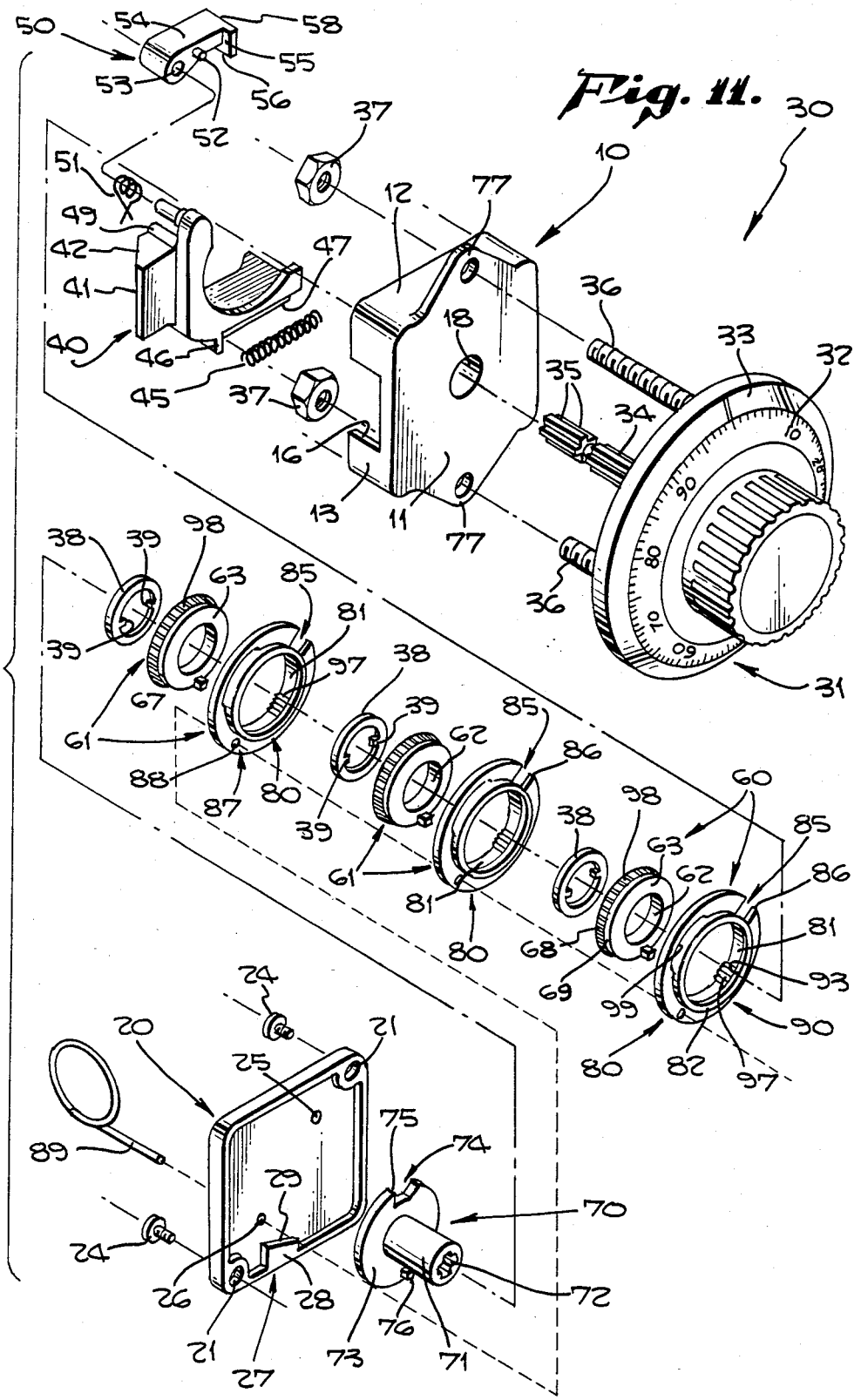
FIG. 11 is an exploded assembly plan of the parts of the lock mechanism of FIG. 1.

DETAILED DESCRIPTION OF A PREFERRED EXEMPLARY EMBODIMENT:

FIGS. 1–12 show a preferred exemplary embodiment of a lock utilizing the improvements of the present inventiond. Referring initially to FIG. 11, the preferred embodiment comprises a combination lock including a lock mechanism 30 encased within a lock housing 10 and a mating lock cover 20.

More specifically, lock housing 10 has single piece construction and is formed with a base portion 11 and four sidewall portions 12. One of those sidewall portions 13 includes a rectangular U-shaped cutout 16 for forming a bolt aperture when lock housing 10 is combined with lock cover 20 as particularly shown in FIGS. 1, 2, 6, and 9.

Figure 1:
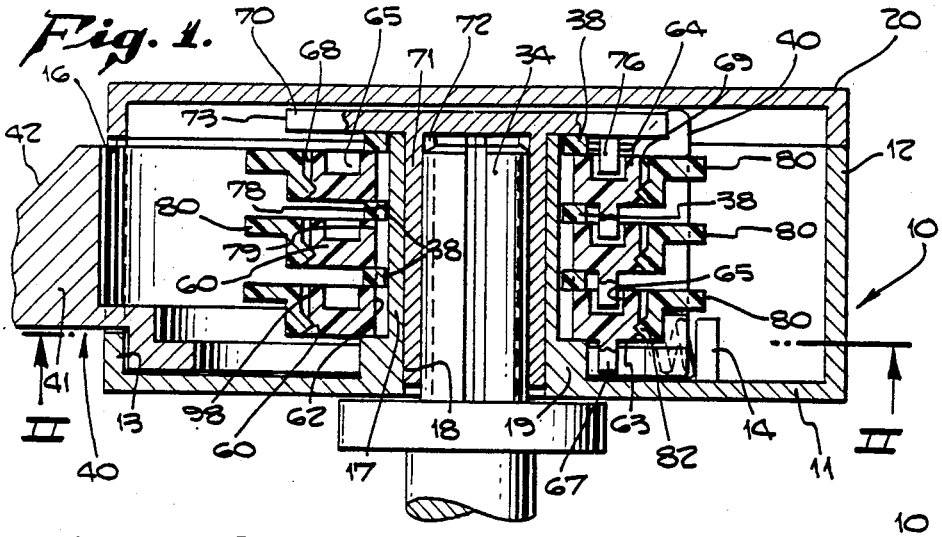
FIG. 1 is a side elevation of the present invention taken in section along a plane which substantially bisects the combination lock mechanism.

Referring to FIG. 1, lock housing 10 further includes a jounal sleeve 17 projecting upwardly from base 11 and disposed centrally within the lock housing 10. Journal sleeve 17 has a cylindrical bore 18 extending therethrough and adapted to receive a driver 70 as will be later described. Journal sleeve 17 is further provided with a substantially cylindrical exterior surface 79 which, in addition to bore 18, serves as a journal surface and about which multiple tumbler wheels 60 may be mounted and rotated as will be later described. The exterior surface 79 of the journal sleeve 17 is provided with two diametrically opposed aligning grooves 78 for cooperation with guides 39 of multiple spacers 38 which will be later described. The portion of the exterior surface 79 of journal sleeve 17 proximate the base 11 is further provided with a cylindrical collar 19 having a diameter greater than the external diameter of journal sleeve 17 and serving as a support for the first of multiple tumbler wheels 60 mounted thereon as, again, will be described in more detail.

A pair of mounting apertures 15 are provided in opposing corners of lock housing 10 for receiving fastening means, particularly mounting screws 24 for mounting lock cover 20 to the lock housing 10. Said mounting apertures 15, particularly shown in FIG. 2, may be cast in the lock housing 10 and adapted to receive self-tapping machine screws as are known in the art.

Figure 6:
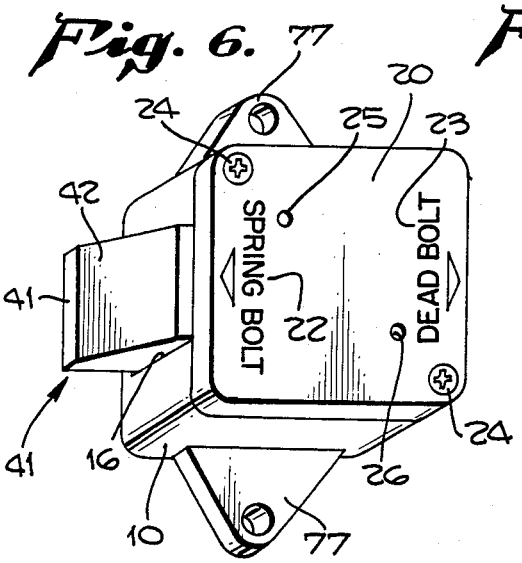
FIG. 6 is an orthographic top view of the assembled lock mechanism of the present invention adapted for spring-bolt operation.

Lock cover 20 is adapted to mate with lock housing 10 to form an enclosure having an internal chamber substantially the shape of a rectangular solid. FIGS. 6 and 9 show lock cover 20 attached to lock housing 10 by fastening means, particularly machine screws 24 extending through mounting apertures 21 of lock cover 20 and into mounting apertures 15 of lock housing 10. The mounting apertures 21 and 15 of the lock cover and lock housing are arranged such that the lock cover may be mounted with respect to the lock housing in more than one orientation. FIG. 6 shows the lock cover 20 mounted to the lock housing 10 in a first orientation and FIG. 9 shows the same lock cover 20 mounted to the same lock housing 10 in a second orientation in which lock cover 20 has been rotated 180 degrees.

Referring to FIGS. 6, 9, and 10, lock cover 20 is further provided with mode selecting means 27. Mode selecting means 27 includes the provision of spring bolt indicia 22 and dead bolt indicia 23 on the exterior surface of lock cover 20 and the provision of mode selecting structure 28 on the interior surface of lock cover 20 as particularly shown in FIG. 10. Mode selecting structure 28 may selectively engage lock mechanism 30 in a manner which will be later described, said engagement being determined by the orientation of the lock cover 20 relative to the lock housing 10 and identified by the proximity of either the spring bolt indicia 22 or the dead bolt indicia 23 with the bolt means 40 extending through bolt aperture 16 in lock housing 10.

The combined structure of the lock, including lock mechanism 30 having bolt means 40, contained within lock housing 10 and lock cover 20, may be mounted to the door of an enclosure to maintain the door of the enclosure in a closed and locked position thereby securing the contents of the enclosure from theft and preventing unwanted entry into the enclosure. In order to accomplish this function, the assembled lock as shown in FIGS. 6 and 9 is mounted to the interior surface of the door proximate an edge thereof such that the bolt means 40 may extend beyond the edge of the door to engage a latch or recess carried by the door frame of the enclosure whenever the door is in a closed and locked condition. A pair of mounting flanges integral with housing 10 and having apertures 77 is shown in FIG. 6 and facilitates the mounting of the lock mechanism to the interior surface of the door using mounting screws 36 as shown in FIG. 11.

The particular type of lock mechanism contained within the lock housing 10 in this preferred exemplary embodiment is a combination lock mechanism 30. Accordingly, the door of the enclosure is further provided on its exterior surface with a face plate 33 and a combination lock dial 31 containing numeric indicia 32 alignable with a reference point appearing on face plate 33. A shaft 34 attached to dial 31 extends through the door into the bore 18 of journal sleeve 17 wherein it is operably connected to driver 70. As shown in FIG. 11, shaft 34 is provided with break-away portions of its extended length such that the shaft 34 may be easily adjusted for various door widths which it must penetrate and still leave sufficient shaft length having keyway grooves 35 to operably connect with the keyway guide 72 of driver 70. Mounting screws 36 extend from face plate 33 on the exterior surface of the door through the door and through the mounting flange apertures 77 on the interior surface of the door at which point mounting nuts 37 secure the combined face plate 33, combination lock dial 31, and lock mechanism 30 contained within lock housing 10 to the door of the enclosure such that bolt means 40 extends beyond the edge of the door to engage the door frame of the enclosure.

Figure 2:
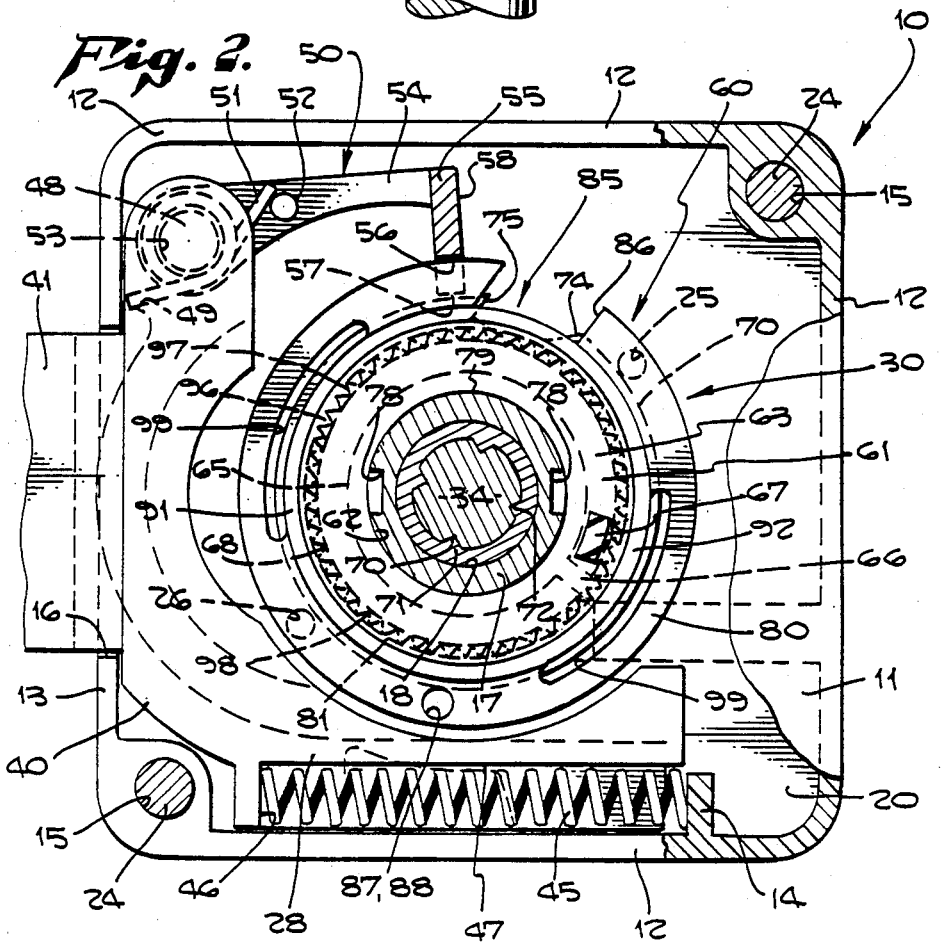
FIG. 2 is a partially cut-away bottom elevation of the lock mechanism of FIG. 1 taken in section along plane II—II of FIG. 1, showing the bolt in the locked position, and the cover oriented for spring-bolt mode of bolt operation.
Figure 4:
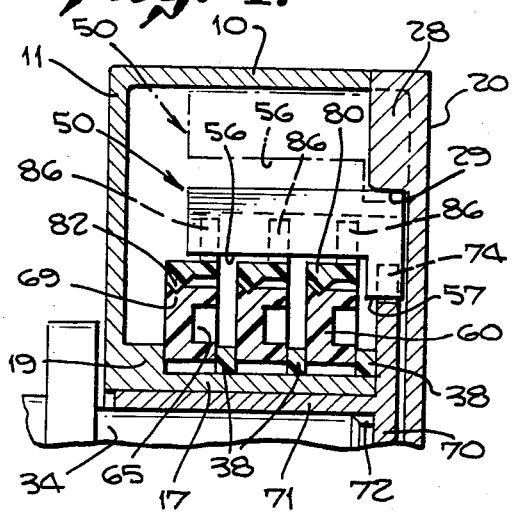
FIG. 4 is an enlarged partial side section of the lock mechanism of FIG. 3 taken in section along line IV—IV of FIG. 3.
Figure 5:
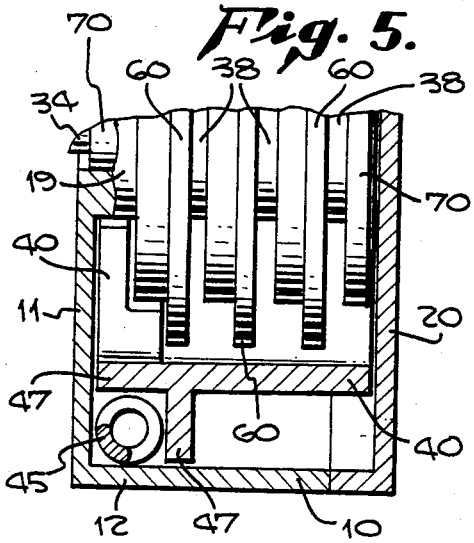
FIG. 5 is an enlarged partial side elevation of another portion of the lock mechanism of FIG. 3 taken in section along line V—V of FIG. 3.

The combination lock mechanism 30 of the present invention particularly includes bolt means 40 having two alternative configurations and permitting two alternative modes of bolt operation. Two bolt configurations are contemplated for use with the present invention, a spring-bolt configuration 41 and a dead-bolt configuration 43. Either of these bolt configurations is generally referred to as bolt means 40. The bolt means is formed of a solid structure contained within lock housing 10 and movable such that a bolt portion may selectively translate into and out of bolt aperture 16 to selectively protrude external of the lock housing and engage the door frame of the enclosure. A bolt spring 45 is provided for biasing the bolt means 40 to cause the bolt portion to extend outward of the lock housing 10 such that it moves from the position shown in FIG. 3 to the position shown in FIG. 2, engaging the door frame of the enclosure. Specifically, bolt spring 45, as particularly shown in FIG. 2, is mounted between the spring biased surface 46 of the bolt structure and the corresponding spring biased surface 14 of the lock housing. Referring to FIG. 5, the bolt structure further includes spring channel walls 47 having the shape of a rectangular solid when in cooperation with a sidewall 12 and edge of the base 11 of the lock housing to form a longitudinally elongated chamber for containing the bolt spring 45 in an operative condition.

The dead-bolt configuration 43 of bolt means 40 specifically contemplates that the portion of the bolt structure extending outwardly of the lock housing through bolt aperture 16 has the shape of a rectangular solid which engages the door frame of the enclosure in a manner which most securely prevents unwanted entry into the enclosure.

The spring-bolt configuration 41 of bolt means 40 is similar to the dead-bolt configuration 43 with the additional provision of a ramp surface 42 angularly disposed with respect to the otherwise rectangular solid surface of the protruding portion of the bolt extending beyond bolt aperture 16. Ramp surface 42 is inclined at an acute angle with respect to the axis of translational motion of the bolt, protracting and retracting with respect to the lock housing 10. In this manner, ramp surface 42 may cooperate with a latch surface of the door frame of the enclosure to translate motion of the door in a closing direction into motion of the bolt means 40 into a retractive direction into the lock housing 10 until such time as the ramp surface 42 has passed over an outward extending portion of the latch surface of the door frame and is no longer in occlusion therewith such that, in response to bolt spring 45, the bolt means 40 may once again protract outward of the lock housing 10 and into engagement with the door frame thereby maintaining the door in a locked condition. This spring-bolt configuration 41 permits locking of the door of the enclosure in an automatic manner simply by closing the door. On the other hand, the dead-bolt configuration 43 requires a positive manipulation of the lock mechanism to translate the bolt from the unlocked to the locked position.

Accordingly, the lock mechanism 30 may be selectively operated in two alternative normal modes of bolt operation. The selection of the mode of bolt operation is accomplished by the rotational orientation of the lock cover 20 with respect to lock housing 10. The first mode of bolt operation is referred to as dead-bolt mode and is typically associated with the use of a dead-bolt configuration 43 of bolt means 40. The second mode of bolt operation is referred to as spring-bolt mode and is typically associated with the use of a spring-bolt configuration 41 of bolt means 40. The matching of the bolt configuration with the mode of bolt operation is not required by the present invention and thus a spring-bolt configuration 41 may be used with a dead-bolt mode of bolt operation and a dead-bolt configuration 43 may be used with a spring-bolt mode of bolt operation. These combinations are in addition to the contemplated combinations of a spring-bolt configuration 41 with a spring-bolt mode of bolt operation and a dead-bolt configuration 43 with a dead-bolt mode of bolt operation.

Essentially, the dead-bolt mode of bolt operation permits motion of the bolt means 40 from the locked position to the unlocked position only when the proper combination has been dialed. The spring-bolt mode of bolt operation permits motion of the bolt means 40 from the locked to the unlocked position either when the proper combination has been dialed or when a retracting force is applied to the bolt itself overcoming bolt spring 45 such as when ramp surface 42 engages the door latch surface during closing of the door.

Bolt means 40 is further provided with pawl post 48 having a cylindrical shape and adapted to receive and mount pawl 50. Additionally, bolt means 40 is provided with pawl spring stop 49, as particularly shown in FIG. 10, for anchoring one end of pawl spring 51 as will be further described.

Pawl 50 is provided as particularly shown in FIGS. 2, 3, 10, and 11. Pawl 50 is particularly adapted for mounting upon pawl post 48, such that the pawl may rotate about the post such that a tumbler wheel engaging portion of the pawl may rotate radially inward and outward with respect to the multiple tumbler wheels 60 to engage the respective gate means 85. Accordingly, pawl 50 is provided with a cylindrical bore 53 for sliding over and rotating about pawl post 48 and is further provided with a pawl spring stop 52 which, as shown in FIG. 11, has the shape of a pin.

Pawl spring 51 is provided for mounting about pawl post 48 and engaging the pawl spring stop 49 of bolt means 40 and the pawl spring stop 52 of pawl 50 for rotationally biasing the pawl 50 relative to pawl post 48.

More specifically, pawl 50 is comprised of an arm 54 having a cylindrical bore 53 at one end which is adapted to receive pawl post 48, and a head 55 at the other end. Head 55 has two portions which are alignable with the rotational portions of the lock mechanism to permit unlocking of the bolt means 40. The first portion is the tumbler wheel engaging surface 56 which, in the preferred embodiment, is a longitudinally elongated cam follower type surface which contacts the periphery of each of the three tumbler wheels 60. The second portion of pawl head 55 is driver engaging surface 57 which is similarly a cam follower type of surface for engaging the periphery of driver 70. Driver 70, as will be more fully described, includes cutout 74 similar to the gate means 85 which, when not in alignment with the driver engaging surface 57 of pawl 50, prevents the pawl from rotating radially inward with respect to the multiple tumbler wheels 60. The assembled pawl 50, pawl spring 51, and bolt means 40 is shown in FIG. 10. Pawl spring 51 is a coil spring adapted to bias pawl 50 such that the outward extension of the pawl head 55, rotates radially inward with respect to the multiple tumbler wheels 60. In response to the biasing of pawl spring 51, pawl 50 may move from the ghosted position of FIG. 4 to the solid position of FIG. 4 whenever the gate means 85 of each of the multiple tumbler wheels 60 and the driver 70 are mutually aligned. Accordingly, misalignment of the gate means 85 of any one of the three tumbler wheels 60 or the driver 70 maintains pawl 50 in its radially outward position particularly shown in FIG. 2 which prevents the lock mechanism 30 from causing an unlocking motion of bolt means 40.

Figure 3:
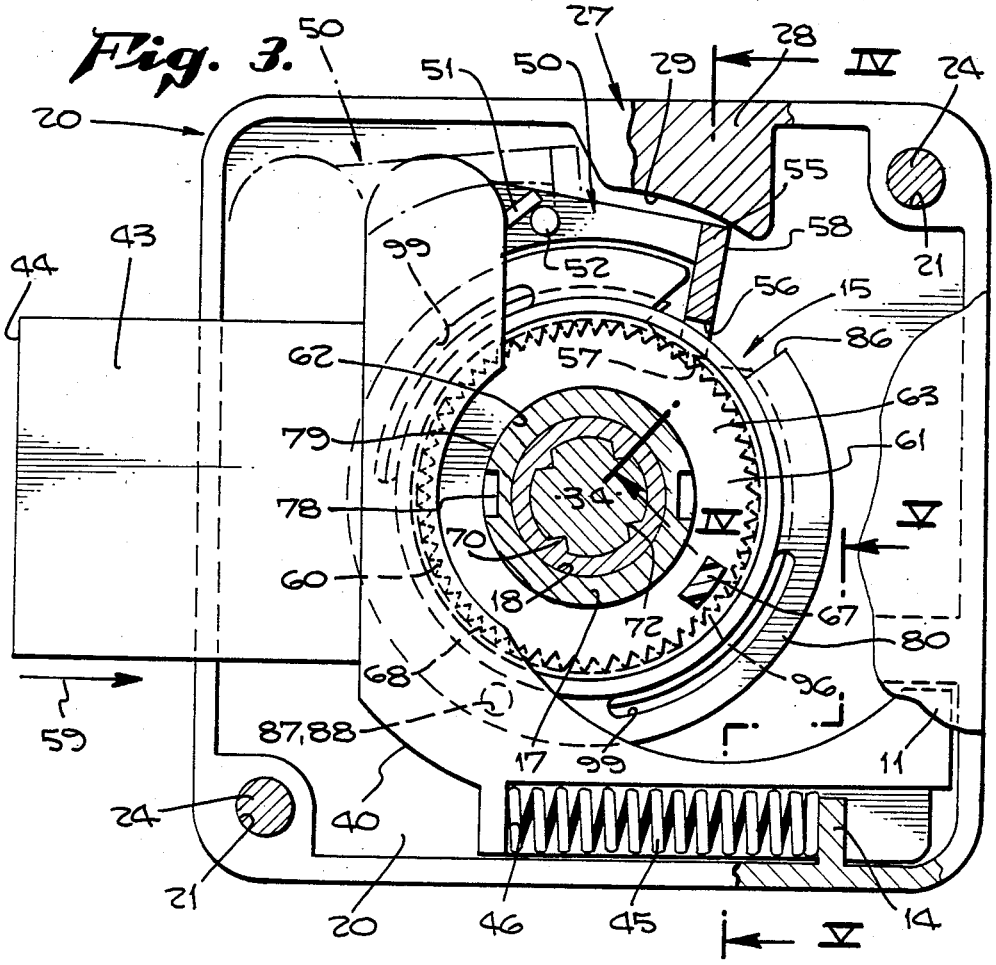
FIG. 3 is a partially cut-away bottom elevation of the lock mechanism of FIG. 1, similar to FIG. 2, taken in section along plane II—II of FIG. 1, showing the bolt in an unlocked position, and the lock cover oriented for dead-bolt mode of bolt operation.

Pawl 50 further includes a mode selecting structure engaging surface 58 for selectively engaging the pawl engaging surface 29 of mode selecting structure 28 contained on lock cover 20. The cooperation between the pawl 50 and the mode selecting structure 28 contained on lock cover 20 is particularly shown in FIG. 3. The ghosted position of pawl 50 shown in FIG. 3 is associated with those times when the gate means 85 of any one of the multiple tumbler wheels 60 or the cutout 74 of the driver 70 is misaligned with the head 55 of pawl 50. When the lock cover 20 is oriented in the position associated with the dead-bolt mode of bolt operation, the mode selecting structure 28 is positioned as shown in FIG. 3 and the pawl engaging surface 29 of that structure may contact the mode selecting structure engaging surface 58 of head 55 of pawl 50 which prevents translational motion of the pawl from left to right which accompanies unlocking motion of bolt means 40, the direction shown by arrow 59 in FIG. 3. In this configuration, an externally supplied force on the portion of the bolt means 40 protruding from lock housing 10 in the direction of arrow 59 is not capable of translating bolt means 40 from the locked position shown ghosted in FIG. 3, to the unlocked position, shown solid in FIG. 3. It is only when the proper combination has been dialed and the gate means 85 and cutout 74 are aligned that head 55 of pawl 50 may rotate radially inward into the gate means 85 and cutout 74 permitting the mode selecting structure engaging surface 58 to rotate out of engagement with the mode selecting structure 28 and thereby make the bolt means 40 capable of translating to the bolt unlocked position, shown solid in FIG. 3, in response to a further, clockwise in FIG. 3, manipulation of the lock dial 31.

During spring-bolt mode of bolt operation, the lock cover 20 is mounted in a reverse orientation such that the mode selecting structure 28 is in the position shown by FIG. 2, out of engagement with head 55 of pawl 50. In this mode of bolt operation, a force in the direction of arrow 59 on bolt means 40 may overcome the biasing of bolt spring 45 and cause the bolt means 40 to be translated from the locked position to the unlocked position, left to right as seen in FIG. 3. It is only when each of the gate means 85 of the multiple tumbler wheels 60 and the cutout 74 of driver 70 are aligned that the bolt means 40 may be translated from the locked position to the unlocked position by a further manipulation of the lock mechanism, specifically a further rotation of lock dial 31 in a clockwise direction as seen in FIG 3.

Rotatably mounted about journal sleeve 17 are multiple tumbler wheels 60 which may be interspaced by spacers 38 and a driver 70, as particularly shown in FIGS. 1–5 and 11.

The improved multiple tumbler wheels 60 of the present invention have a two-part construction wherein means for provided for two normal modes of operation. The preferred embodiment includes three identical tumbler wheels 60 each having an inner drive member 61 and an outer ring or gate ring 80. The inner drive member 61 is substantially an annular ring having a cylindrical bore 62 of a size sufficient that the inner drive member 61 may be mounted about the external surface 79 of journal sleeve 17 and freely rotatable with respect thereto. The annular ring of inner drive member 61 has a first side 63 shown in FIG. 7 and a second side 64 shown in FIG. 8. First side 63 is provided with an eccentrically located projection 67 which protrudes perpendicularly from the first side 63 of inner drive member 61. The second side 64 of inner drive member 61 includes an annular groove 65 of a size and depth sufficient to receive the projection 67 of an adjacently mounted inner drive member 61 such that when one of the inner drive members rotates with respect to the other one, the projection 67 on the first side 63 of the first inner drive member rotates in the circular path provided by groove 65 on the second side 64 of the second, adjacent inner drive member. Groove 65 is provided with a stop 66 which may engage a projection 67 of an adjacent inner drive member as it travels in groove 65 to cause the two inner drive members to rotate in unison subsequent to one of the two inner drive members rotating less than a full revolution independent of the other inner drive member. This function is illustrative of the first of two normal modes of contemplated operation of the three tumbler wheels of the preferred embodiment. Said mode is referred to as a combination dialing mode and in this mode, the inner drive member 61 of each tumbler wheel 60 may rotate independently of adjacently mounted inner drive members 61 for less than a full rotation in any one direction until such time as a further rotation causes the projection 67 of one of the inner drive members 61 to rotate within groove 65 into contact with stop 66 of the adjacent inner drive member 61.

Inner drive member 61 is further defined by a peripheral edge 68. Peripheral edge 68 further includes an annular groove 69 proximate the first side 63 of the inner drive member 61. As best seen in FIGS. 1 and 11, groove 69 is particularly configured to mate with ridge 82 of outer ring 80, as will be more fully described. Additionally, peripheral edge 68 is provided with ratchet teeth 98 extending about the periphery of inner drive member 61 proximate its second side 64. These ratchet teeth 98 cooperate with gripping means 90 of outer ring 80 in a manner which will be more fully described.

Figure 7:
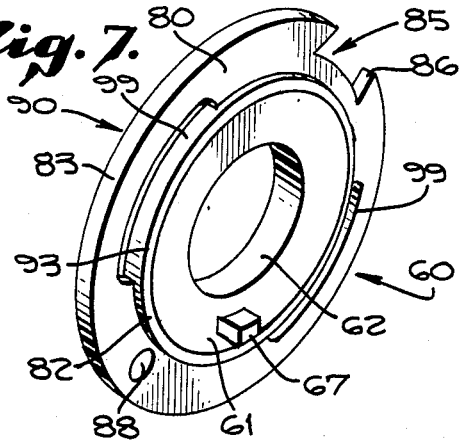
FIG. 7 is a perspective view of a first side of a tumbler wheel of the present invention.
Figure 8:
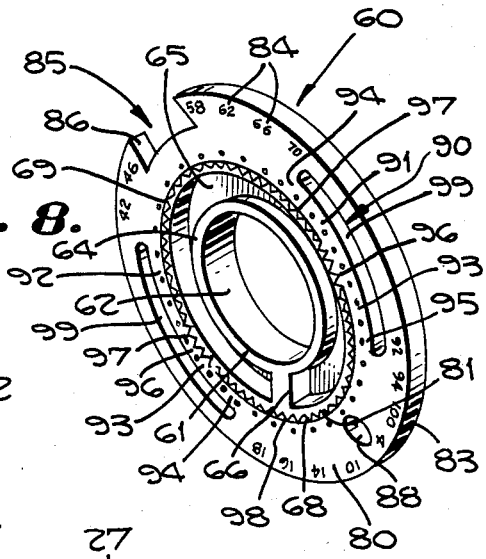
FIG. 8 is a perspective view of the second side of the tumbler wheel of FIG. 7.

The second part of each of the multiple tumbler wheels 60 is outer ring or gate ring 80. Outer ring 80 has an inner bore 81 having a ridge 82 extending about its interior and adapted such that the bore 81 of outer ring 80 may be mounted about the peripheral edge 68 of inner drive member 61. Ridge 82 within bore 81 fits into groove 69 on peripheral edge 68 and cooperates to prevent axial translation of outer ring 80 relative to inner drive member 61. This groove and ridge construction permits outer ring 80 to have only rotational motion relative to inner drive member 61. In this manner, outer ring 80 may be snapped onto the periphery of inner drive member 61 to form multiple tumbler wheels 60 as shown in FIGS. 7 and 8.

Outer ring 80 has a periphery 83, numeric indicia 84 positioned on one side of outer ring 80 proximate its periphery 83, and includes gate means 85 located at one point on the periphery of outer ring 80. Gate means 85 is operably formed of a cutout 86 from the peripheral edge 83 of outer ring 80. The periphery 83 with gate means 85 together act as a cam surface which cooperates with the tumbler wheel engaging surface 56 of pawl 50. Gate means 85 functions to permit the head 55 of pawl 50 to rotate about pawl post 48 radially inward with respect to the tumbler wheel whenever the gate means 85 is in alignment with the head 55 of pawl 50. Outer ring 80 further includes orienting means 87 which, in the preferred embodiment, is comprised of a single orienting aperture 88 having a predetermined angular orientation relative to gate means 85 and positioned proximate periphery 83 of outer ring 80. Orienting aperture 88 has an axis eccentric to the axis of tumbler wheel 60 and is adapted to receive a combination changing pin 89 under predetermined conditions which will be more fully described.

Gripping means 90 are included in outer ring 80 for cooperation with inner drive member 61. It is specifically contemplated by the present invention that gripping means 90 impart a predetermined resistance to relative rotation of outer ring 80 relative to inner drive member 61 and that when said predetermined resistance to relative rotation has been overcome, that relative rotation occurs in an integer or ratcheting manner such that outer ring 80 may have only a finite number of rotational positions relative to inner drive member 61. It is notable that indicia 84 may numerically identify said finite number of rotational orientations, or be a whole number multiple thereof, and may correspond with the numeric indicia 32 on combination lock dial 31.

It is specifically contemplated that gripping means 90 impart a predetermined frictional resistance to rotation of outer ring 80 relative to inner drive member 61 in order to provide two normal modes of operation for the tumbler wheels 60. The first of said modes of operation is a combination-dialing mode wherein the two parts of each of the tumbler wheels 60 rotate in a unitary manner in response to the frictional resistance to rotation provided by gripping means 90. The second contemplated mode of operation is referred to as combination-changing mode wherein inner drive member 51 rotates independently of outer ring 80 thereby altering the relative rotational orientation of the two parts. It is this relative rotational orientation, the rotational juxtaposition of stop 66 and projection 67 relative to cutout 86 of gate means 85 that determines one of the sequence of combination lock dial manipulations necessary to unlock the lock mechanism 30.

In the preferred embodiment, gripping means 90 comprises a pair of diametrically opposed gripping straps, first strap 91 and second strap 92. Each of these gripping straps 91 and 92 is a member in tension 93, each tensioned between first and second angular positions 94 and 95 of outer ring 80. Each of the gripping straps 91 and 92 has a tangential contact point 96 which may include one or more contact teeth 97 for engaging the multiple ratchet teeth 98 on the periphery of inner drive member 61. It has been found that rather than using a cantilevered construction of resilient material, a more predictable and reliable resistive force is created by using a member in tension 93. Each of the members in tension 93 may be easily manufactured in an outer ring 80 formed or cast of a resilient material by providing a cutout 99 in outer ring 80 centered about each of the diametrically opposed contact teeth 97 forming the first and second grip straps 91 and 92. It may be seen in FIG. 2, that this arcuate cutout 99 causes an inward portion of outer ring 80 to extend between first and second angular positions 94 and 95. When the outer ring 80 is snapped onto the periphery of inner drive member 61 to form a tumbler wheel 60, the peripheral edge 68, having a diameter slightly larger than the unstressed circumference of bore 81, causes the contact teeth 97 at the tangential contact point 96 to be repositioned radially outward from their unstressed position thereby stressing that tangential portion and creating a member in tension 93. The member in tension 93, having a tangential contact point 96 on the peripheral edge 68 of inner drive member 61 imparts a predetermined radially inward force which thereby creates a predetermined frictional resistance to rotation between tangential contact point 96 and the contacted portion of peripheral edge 68 of inner drive member 61. The contact teeth 97 positioned at that tangential contact point 96 engage ratchet teeth 98 of inner drive member 61 thereby causing the rotation of outer ring 80 relative to inner drive member 61 to occur in a ratcheting manner whenever the frictional resistance to rotation provided by gripping means 90 is overcome.

The previously mentioned combination changing mode of operation is accomplished by inhibiting the rotation of outer ring 80 relative to lock housing 10 by the insertion of a combination changing pin 89 through orienting aperture 88 in outer ring 80 of each of the tumbler wheels 60 and through one of the orienting apertures 25 and 26 of lock cover 20. The inner drive members 61 of the multiple tumbler wheels 60 may then be rotated relative to their respective outer rings 80 in response to rotational manipulations of the combination lock dial 31.

Gripping means 90 must impart a predetermined resistance to relative rotation that falls within two bounds. The lower bound is the minimum frictional resistance necessary to prevent inadvertent rotation of outer ring 80 relative to inner drive member 61 during normal, combination dialing useage of lock mechansim 30. The upper bound is that the maximum frictional resistance to rotation must not be so great that when operating in the combination changing mode in a manner which will be more fully described, that projection 67 extending within an adjacent groove 65 and contacting stop 66 is not sheared or damaged. Accordingly, any number of gripping members may be used to comprise gripping means 90 so long as the net frictional resistance to rotation is within the bounds. In bench testing the preferred embodiment, these lower and upper bounds of frictional resistance to rotation to be imparted by gripping means 90 was measured to be 20 and 40 inch-ounces of torque, respectively.

A driver 70 is provided for communicating the rotational motion of the combination lock dial 31 into rotation of tumbler wheels 60. In the preferred embodiment, driver 70, as shown in FIGS. 1 and 11, has a hollow shaft 71 with a circular flange 73 at one end together forming a hollow cylinder which is open at the other end. Hollow shaft 71 has an interior cylindrical bore which is provided with keyway guides 72. Said bore is particularly configured to receive shaft 34 connected with combination lock dial 31 such that the keyway guides 72 of the bore engage the keyway grooves 35 of shaft 34 causing the dial 31, shaft 34, and driver 70 to rotate in a unitary manner.

Flange 73 on driver 70 has a peripheral edge which includes a cutout 74 which together act as a cam surface when placed in contact with the driver engaging surface 57 of the head 55 of pawl 50. Cutout 74 of driver 70 operates similar to gate means 85 of each of the multiple tumbler wheels 60 in that the cutout must be aligned with the head 55 of pawl 50 in order to permit unlocking motion of bolt means 40 whenever the lock mechanism is in the dead bolt mode of bolt operation. Additionally, cutout 74 is further provided with a pawl driving surface 75 which, when the pawl 50 has been rotated radially inward due to alignment of each of the gate means 85 of the multiple tumbler wheels 60 and the cutout 74 of the driver 70 with the head 55 of the pawl 50, permits a further rotation of dial 31 to engage the driver engaging surface 75 of pawl 50 and overcome the bolt spring 45 causing unlocking motion of bolt means 40.

Flange 73 of the driver 70 is also provided with a projection 76 similar to the projections 67 of the inner drive members 61. Projection 76 is adapted to protrude into the groove 65 and contact the stop 66 of an adjacently mounted tumbler wheel 60. In this manner, rotation of dial 31 causes projection 76 to move in a circular manner within groove 65 of the first adjacent tumbler wheel 60 until it encounters stop 66 contained within that groove 65. Further rotation in the same directon causes the projection 76 of driver 70, due to its contact with stop 66 of the adjacent inner drive member 61, to rotate that adjacent tumbler wheel 60 while the projection 67 of that adjacent tumbler wheel rotates within the groove 65 of the next adjacent tumbler wheel. This cooperation continues for the projections 67 and grooves 65 of each of the three tumbler wheels 60 shown in the preferred embodiment. Accordingly, three complete rotations of the combination lock dial 31 in any one direction will cause each of the projections 67 to be in contact with the stop 66 of the adjacent inner drive member 61 such that driver 70 and all three tumbler wheels 60 continue to rotate in a unitary manner. Subsequent alternating clockwise and counterclockwise rotations in reducing numbers of complete revolutions cause each of the inner drive members 61 to acquire an independent rotational orientation relative to lock housing 10 and, depending on the relative rotational orientation of the stop 66 and projection 67 of inner drive member 61 relative to the gate means 85 of its respective outer gate 80, each of these rotational orientations coincides with a numeric indicia 32 being aligned on lock dial 31 with the reference point on face plate 33. Accordingly, the predetermined sequence of dial manipulations causes each of the gate means 85 and the cutout 74 of driver 70 to be aligned with head 55 of pawl 50 thereby permitting unlocking operation of bolt means 40 in accordance with the combination-dialing mode of tumbler wheel operation.

The combination-changing mode of tumbler wheel operation may be initiated whenever said multiple gate means 85 are in alignment with head 55 of pawl 50 as when the proper combination has been dialed. In this condition, the orienting apertures 88 of each of the outer rings 80 of the multiple tumbler wheels 60 are also in alignment with each other and with an orienting aperture 25 or 26 on lock cover 20. When in this condition, a simple rod-shaped combination changing pin 89 may be inserted in any rotational orientation through these apertures 25 or 26, and 88, to restrict rotation of each of the outer rings 80 relative to lock housing 10. Further manipulation of the lock mechanism dial 31 by cooperation of the projection 76 of driver 70 with the stop 66 of the adjacent inner drive member 61, similarly the projection 67 of that inner drive member 61 with stop 66 of its adjacent inner drive member 61, and similarly for each additional inner drive member 61, causes each of said inner drive members 61 to overcome the resistance to relative rotation between that inner drive member 61 and its respective outer gate ring 80 to produce relative rotation therebetween such that each of the inner drive members 61 may acquire a new rotational orientation relative to its respective outer ring 80. By dialing the newly desired sequence of combination dial manipulations, the new combination, the combination of the lock is changed and each of the tumbler wheels 60 acquires a rotational orientation of its outer ring 80 relative to its inner drive member 61 in accordance with that new combination. Subsequently, the combination changing pin 89 may be removed and the lock will resume functioning in the combination-dialing mode, operating to allow motion of bolt means 40 in the unlocking direction whenever the new combination has been properly dialed.

Referring particularly to FIG. 11, the elements of the preferred embodiment may be easily assembled during manufacture by the following sequence. First, lock housing 10 may be provided and positioned base 11 down such that the subsequent parts may be dropped into it. Bolt spring 45 may be dropped into the bottom of lock housing 10 such that one end thereof is proximate bolt spring mounting means 14. Selection may be made between spring-bolt configuration 41 and dead-bolt configuration 43 for the desired bolt means 40. Pawl spring 51 may be dropped onto pawl post 48 of bolt means 40. Pawl 50 may be similarly positioned on pawl post 48 and rotated such that the pawl spring 51 is tensioned between pawl spring stop 52 of pawl 50 and pawl spring stop 49 of bolt means 40 such that the pawl 50 is biased to rotate radially inward relative to the journal sleeve 17 of the lock housing 10. Together the bolt means 40, the pawl spring 51 and the pawl 50 assemble as shown in FIG. 10. This assembly may then be inserted into lock housing 10 such that the bolt 40 protrudes through bolt aperture 16. Bolt spring 45 is positioned relative to the bolt means 40 such that the other end of the spring is proximate the spring biased surface 46 of the bolt means 40 and the spring 45 extends therebetween in an operative condition, as particularly shown in FIG. 2.

Once the bolt means 40, bolt spring 45, pawl spring 51 and pawl 50 have been inserted into lock housing 10, each of multiple tumbler wheels 60 and spacers 38 may be dropped onto the exterior surface 79 of journal sleeve 17. More particularly, each tumbler wheel 60 is assembled by snapping an inner drive member 61 into the interior of bore 81 of the respective outer ring 80 thereby engaging ridge 82 with groove 69, each with a predetermined rotational orientation which specifies one of the sequence of combination dial manipulations necessary to unlock the lock mechanism 30. The numeric indicia 84 on outer ring 80 serves to identify that portion of the sequence of dial manipulations associated with that particular tumbler wheel by identifying that indicia 84 proximate the projection 67 of the respective inner drive member 61.

A first tumbler wheel 60 is positioned about the exterior surface 79 of journal sleeve 17 such that its first side 63 is down or adjacent base 11 of lock housing 10. The tumbler wheel 60 may be then dropped or slid down journal sleeve 17 into contact with collar 19. A first spacer 38 may be oriented such that the spacer guides 39 align with the aligning grooves 78 on the exterior surface 79 of journal sleeve 17 and the spacer 38 may be slid or dropped down journal sleeve 17 into contact with the first tumbler wheel 60. This sequence of assembly repeats for the second and third tumbler wheels 60 and spacers 38, respectively. Driver 70 may be inserted such that the hollow shaft 71 is inserted into the bore 18 of journal sleeve 17 simply by dropping or sliding the driver 70 into said journal sleeve 17.

One of two modes of bolt operation are selected, either spring-bolt mode or dead-bolt mode, and lock cover 20 is rotationally oriented such that either the spring-bolt indicia 22 or the dead-bolt indicia 23 is positioned proximate the bolt aperture 16 of lock housing 10 with the bolt portion of bolt means 40 extending therethrough in accordance with said selection. Lock cover 20 may then be fitted onto lock housing 10 and fastened thereto by the insertion of fastening means, specifically screws 24, through the mounting apertures 21 of lock cover 20 and into the mounting apertures 15 of lock housing 10.

The assembled lock mechanism 30 within lock housing 10 and lock cover 20 may then be fastened to the door of an enclosure using mounting screws 36 and mounting nuts 37 which extend through mounting flanges 77 of lock housing 10. Similarly, face plate 33 may be attached to the opposite side of the door. Shaft 34 may be inserted through an aperture of the door and into contact with the interior of the hollow shaft 71 of driver 70. Dial 31 may then be press fit onto the end of shaft 34 thereby completing the assembly of the lock mechanism.

Having thus disclosed a preferred exemplary embodiment of a combination lock having two part tumbler wheel construction, simple assembly, and changeable combination features in accordance with the present invention, it should be apparent to those skilled in the art that the present invention accomplishes the objectives and attains the advantages discussed herein and that various modifications, adaptations, and variations can be made within the scope and spirit of the present invention which is limited only as defined by the following claims.

What is claimed is:

1. In a lock having a lock housing, a lock mechanism contained in said housing, a bolt for selectively maintaining the door of an enclosure in a closed and locked condition, said lock mechanism permitting said bolt to acquire an unlocked condition permitting said door to open in response to pre-determined manipulations of said lock mechanism, the improvement comprising the provision of mode selection means including:

a bi-positional lock cover cooperating with said lock housing to encase said lock mechanism, said lock cover alternatively mountable on said lock housing in one of two orientations; and structure contained on the interior surface of said lock cover for engaging said lock mechanism and causing its mode of operation to change only when said lock cover is selectively mounted in one of the two orientations.

2. The lock of claim 1 wherein the first of said two orientations is associated with a spring-bolt mode of bolt operation, the second of said two orientations is associated with a dead-bolt mode of bolt operation, and said mode selecting structure engages said lock mechanism causing said mechanism to change from said spring-bolt mode to said dead-bolt mode only when said lock cover is attached to said lock housing in said second orientation.

3. In a lock having a lock housing, a lock mechanism contained in said housing, a bolt for selectively maintaining the door of an enclosure in a closed and locked condition, said lock mechanism controlling movement of said bolt between locked and unlocked positions allowing said door to open in response to predetermined manipulations of said lock mechanism, the improvement comprising bolt mode selection means including:

a bi-positional lock cover attached to said lock housing to encase said lock mechanism, said lock cover being mounted on said housing in one of two alternative positions, said lock mechanism having a first mode of bolt operation whenever said lock cover is mounted in the first alternative position;

bolt mode selection structure contained on the interior surface of said lock cover for engaging said lock mechanism and causing it to have a second mode of bolt operation whenever said lock cover is mounted in the second alternative position; and means on an outer surface of said cover for indicating the mode of bolt operation selected by the positioning of such cover in one of said first and second positions.

4. An improved gate ring for use with an inner drive member to form one of multiple tumbler wheels of a combination lock contained within a lock housing, and having a changeable combination, said improved gate ring comprising;

an annular ring;

mounting means integral with said annular ring for rotatably mounting said annular ring about the periphery of and concentric with said inner drive member; and gripping means integral with said annular ring resisting rotation of said annular ring relative to said inner drive member by engaging the periphery of said inner drive member, said gate ring and said inner drive member having a first mode of operation by which said gripping means preserves the rotational orientation of the gate ring relative to the inner drive member; and a second mode of operation by which the resistance of rotation of the gripping means is overcome and said gate ring rotates relative to said inner drive member; wherein said gripping means includes at least one gripping strap portion of said annular ring tensioned between two angularly displaced locations on said gate ring and tangentially contacting the periphery of said inner drive member for resisting relative rotation.

5. The improved gate ring of claim 4 including the provision of reorienting means for selectively causing said second mode of operation and changing the rotational orientation of said gate ring relative to said inner drive member by selectively preventing rotation of the gate ring relative to the lock housing.

6. The improved gate ring of claim 5 wherein said reorienting means includes a single cylindrical aperture eccentric of said annular ring and positioned substantially proximate the periphery of said annular ring for receiving and cooperating with a cylindrical pin selectively inserted through a hole in the lock housing, said pin being insertable only when said gate ring has acquired a pre-determined angular orientation, whereby insertion of said pin into said aperture causes any rotation of the inner drive member to overcome the resistance to relative rotation of said gripping means resulting in rotation of said inner drive member relative to said gate ring and thereby producing a change in the rotational orientation of the gate ring relative to the inner drive member thereby changing the combination of the lock.

7. The improved gate ring of claim 4 wherein said gripping means includes the provision of multiple teeth evenly spaced about the periphery of said drive member, and the provision of at least one tooth positioned upon a tangentially contacting surface of said gripping strap and biased by said tension into engagement with said multiple teeth of said inner drive member whereby said inner drive member rotates relative to said gate ring in an intermittent ratcheting manner during said second mode of operation.

8. The improved gate ring of claim 4 wherein said gripping means includes the provison of two gripping straps, the point of tangential contact of one gripping strap with the periphery of said inner drive member being diametrically opposed to the point of tangential contact of the other gripping strap with the periphery of said inner drive member, said gripping straps cooperating to resist rotation of said gate ring relative to said inner drive member.

9. The improved gate ring of claim 7 or 8 wherein said dial is provided with incremental indicia and the number of increment indicia appearing on the dial of the combination lock is an integer multiple of the number of teeth on the periphery of said inner drive member.

10. The improved gate ring of claim 4 wherein the resistance to rotation provided by said gripping means is between 20 and 40 inch-ounces of torque, inclusive.

11. An outer ring for a combination lock tumbler wheel rotatably mounted about the periphery of an inner drive ring of the tumbler wheel, said outer ring having means cooperable with a pawl for unlocking the lock in response to manipulations of the dial of the lock, and said outer ring having improved means for driving connection with said inner drive ring producing two anticipated normal modes of operation by providing a predetermined resistance to rotation of said outer ring relative to said inner ring, in a first mode of operation associated with performing the predetermined manipulations necessary to open the lock said predetermined resistance to rotation causing said outer ring and said inner ring to rotate in a unitary manner, and in a second mode of operation associated with changing the predetermined manipulations necessary to open the lock said predetermined resistance to rotation is overcome producing rotation of the outer ring relative to the inner drive ring, said means for driving connection including a resilient integral portion of said outer ring having contact teeth contacting the periphery of said inner drive ring and providing said predetermined resistance to rotation, and said resilient integral portion being provided so as to be a member in tension between two angularly displaced locations on the outer ring and tangentially contacts said periphery of said inner drive ring.

12. The outer ring of claim 11 wherein said means for driving connection includes two diametrically opposed members in tension.

13. The outer ring of claim 11 wherein the periphery of said inner drive ring includes multiple evenly spaced teeth engaging said contact teeth such that said outer ring rotates relative to said inner drive ring in a ratcheting manner.

14. The outer ring of claim 11 wherein said predetermined resistance to rotation is between 20 and 40 inch-ounces of torque.

* * * * *